US011274028B2

(12) United States Patent
Defazio et al.

(10) Patent No.: US 11,274,028 B2
(45) Date of Patent: Mar. 15, 2022

(54) CONTACTLESS INTERFACE FOR A BEVERAGE DISPENSER

(71) Applicant: International H20 Inc., North Miami Beach, FL (US)

(72) Inventors: Juhani Defazio, Miami, FL (US); Ryan Pinagel, Ft Lauderdale, FL (US)

(73) Assignee: International H2O Inc., North Miami Beach, FL (US)

( * ) Notice: Subject to any disclaimer, the term of this patent is extended or adjusted under 35 U.S.C. 154(b) by 0 days.

(21) Appl. No.: 16/894,078

(22) Filed: Jun. 5, 2020

(65) Prior Publication Data

US 2021/0380391 A1 Dec. 9, 2021

(51) Int. Cl.
*B67D 1/08* (2006.01)
*B67D 1/00* (2006.01)

(52) U.S. Cl.
CPC ..... *B67D 1/0888* (2013.01); *B67D 1/0014* (2013.01); *B67D 1/0857* (2013.01); *B67D 1/0895* (2013.01)

(58) Field of Classification Search
CPC .. B67D 1/0888; B67D 1/0857; B67D 1/0895; B67D 1/0014
USPC ..... 222/39, 52–63, 41, 42, 129.1, 132
See application file for complete search history.

(56) References Cited

U.S. PATENT DOCUMENTS 4,917,155 A * 4/1990 Koblasz ..... B67D 1/1238 141/1
5,803,320 A * 9/1998 Cutting ..... B67D 1/0036 222/129.1
5,889,684 A * 3/1999 Ben-David ..... B67D 1/0014 700/282
5,992,684 A * 11/1999 Russell ..... B67D 1/006 222/1
6,182,453 B1 * 2/2001 Forsberg ..... C02F 9/005 62/125
6,237,811 B1 * 5/2001 Ford ..... A47J 31/401 222/129.1
8,636,174 B1 * 1/2014 Motkowski ..... B67D 3/0016 222/1
2002/0046569 A1 * 4/2002 Faqih ..... C02F 9/005 62/188
2003/0089423 A1 * 5/2003 Barton ..... B67D 1/00 141/198
2008/0277420 A1 * 11/2008 Edwards ..... B67D 1/06 222/129.1
2010/0116842 A1 * 5/2010 Hecht ..... B67D 1/0888 222/1
2010/0275779 A1 * 11/2010 Melikyan ..... B01D 53/265 95/213
2012/0035761 A1 * 2/2012 Tilton ..... G06Q 30/0641 700/233

(Continued)

*Primary Examiner* — Lien M Ngo

(74) *Attorney, Agent, or Firm* — Renner, Otto, Boisselle & Sklar, LLP

(57) ABSTRACT

A contactless interface for a beverage dispenser including a sensor and circuitry. The sensor has a field of view and is configured to sense an object located in a detection zone of the sensor. The detection zone is an area within the field of view and at a distance less than a maximum detection distance from the sensor. The circuitry is configured to output a detection signal while the object is sensed within the detection zone. The detection signal is an electrical signal.

15 Claims, 8 Drawing Sheets

(56) References Cited

U.S. PATENT DOCUMENTS

| | | | | |
|---|---|---|---|---|
| 2014/0263400 | A1* | 9/2014 | Kuehl | B67D 1/0861 222/1 |
| 2016/0280527 | A1* | 9/2016 | Griscik | B67D 1/0031 |
| 2016/0368754 | A1* | 12/2016 | Rosenlund | B67D 1/0081 |
| 2018/0303283 | A1* | 10/2018 | Kollep | A47J 31/525 |
| 2019/0161336 | A1* | 5/2019 | Knoll | B67D 1/0895 |
| 2019/0333502 | A1* | 10/2019 | Crawford | G10L 17/22 |
| 2020/0122994 | A1* | 4/2020 | Cimatti | B67D 1/0888 |
| 2020/0361758 | A1* | 11/2020 | Fantappie | B67D 1/0859 |

* cited by examiner

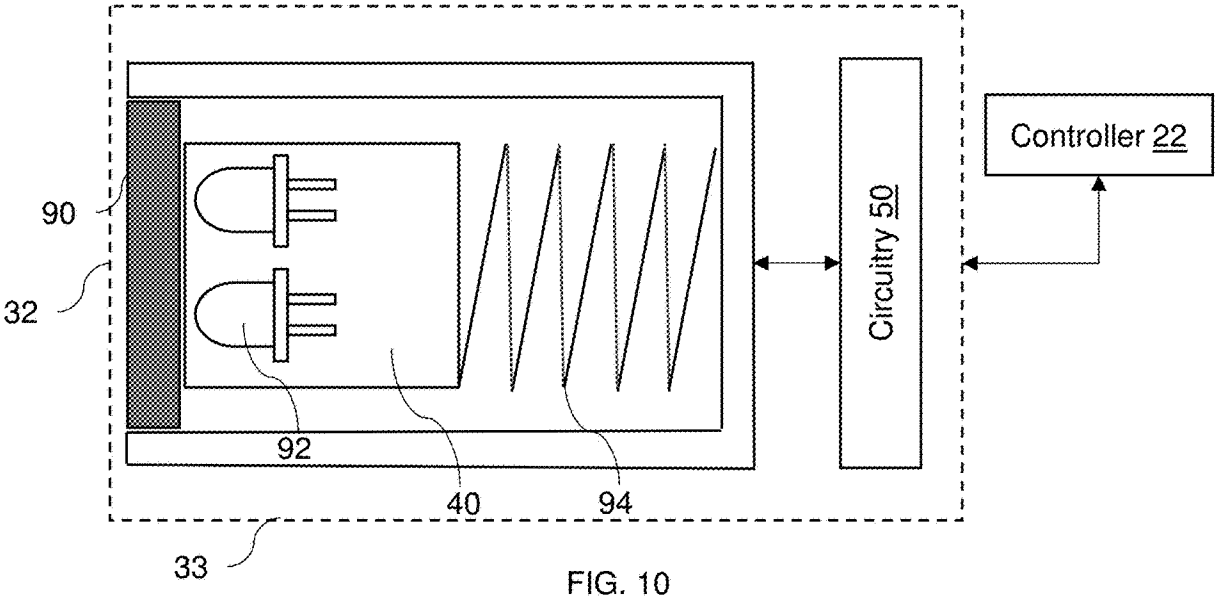
FIG. 10
FIG. 11
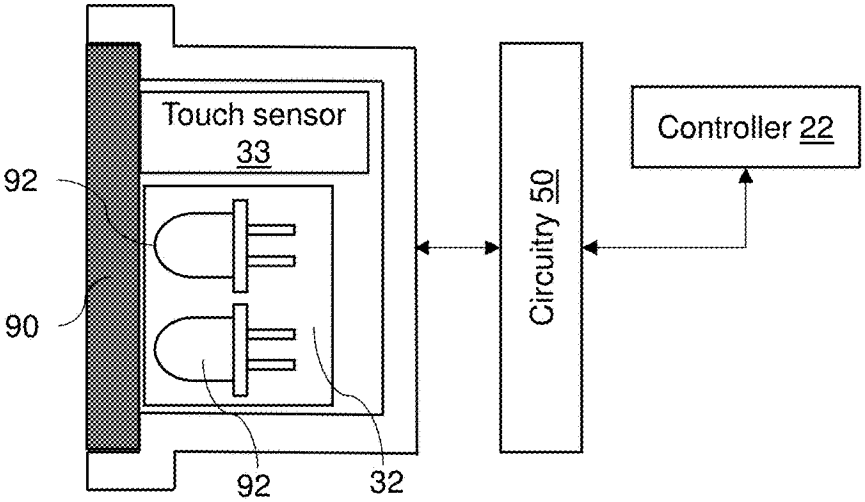

CONTACTLESS INTERFACE FOR A BEVERAGE DISPENSER

FIELD OF INVENTION

The present invention relates to a beverage dispensers and more particularly to contactless interface for modulating liquid dispensing.

BACKGROUND

Water dispensing system are no longer relegated to restaurants and similar commercial establishments. Frequently, water dispensers are being installed in offices, building lobbies and homes, because the water dispensers allow for dispensing hot water, cold water, and sparkling water on demand.

SUMMARY

A water dispenser located in a shared space (e.g., offices, building lobbies, etc.) represents a potential health hazard caused by multiple different people touching buttons on the water dispenser and then touching the lids of their beverage containers (e.g., water bottles, cups, etc.). A contactless interface for interacting with water dispensers is needed.

A contactless interface for a beverage dispenser is provided using contactless sensors. The contactless interface may be included as part of a beverage dispenser or may be added to an existing beverage dispenser by replacing the existing contact buttons of the beverage dispenser. Similarly, the contactless interface may be added alongside traditional mechanically actuated buttons so that users may use the contactless interface or standard push buttons.

While a number of features are described herein with respect to embodiments of the invention; features described with respect to a given embodiment also may be employed in connection with other embodiments. The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

FIG. 10 is a schematic diagram of a mechanical button including a contactless interface.

FIG. 11 is a schematic diagram of a contactless interface located adjacent to a touch sensor.

Figure 1B:
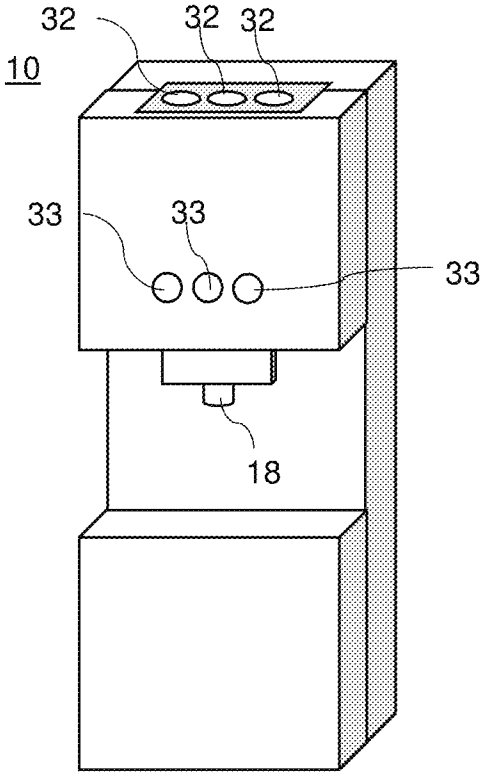
FIG. 1B is a schematic diagram of an exemplary embodiment of a beverage dispenser including a contactless interface on a top of the beverage dispenser.

The present invention is described below in detail with reference to the drawings. In the drawings, each element with a reference number is similar to other elements with the same reference number independent of any letter designation following the reference number. In the text, a reference number with a specific letter designation following the reference number refers to the specific element with the number and letter designation and a reference number without a specific letter designation refers to all elements with the same reference number independent of any letter designation following the reference number in the drawings.

DETAILED DESCRIPTION

The principles described herein may be used in beverage dispensing applications and contactless interfaces for beverage dispensers. Exemplary applications include controlling liquids dispensed from beverage dispensers using contactless interfaces. The principles described herein may be sized down for use in home beverage dispensers or sized up for use in industrial beverage dispensers. Many liquids (e.g., different temperatures, flavors, carbonation, etc.) may be suitable for use with contactless interfaces, the beverage dispensing machine, and control system described herein.

The beverage dispensers, systems, and methods described herein are advantageous in controlling dispensing of liquids from a beverage dispenser without requiring a user to touch the beverage dispenser (e.g., reducing the spread of germs through touching shared surfaces).

Figure 1A:
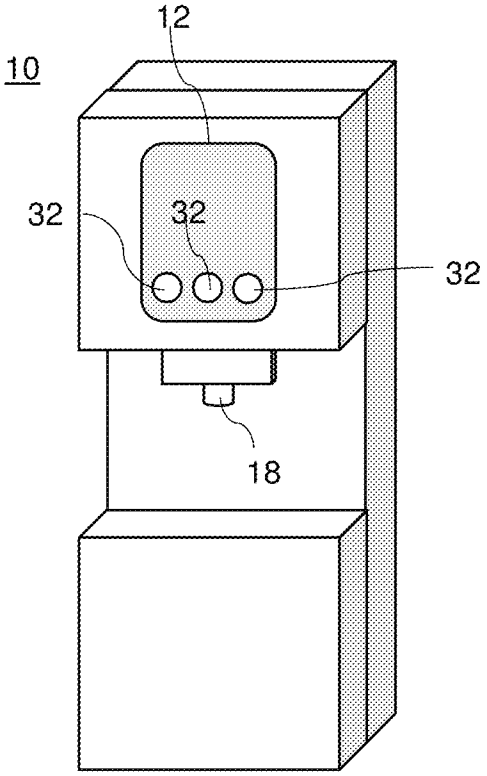
FIG. 1A is a schematic diagram of an exemplary embodiment of a beverage dispenser including a contactless interface on a front of the beverage dispenser.
Figure 3:
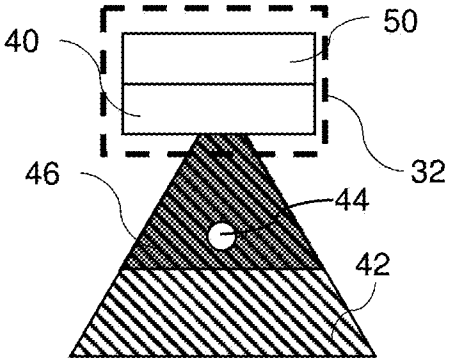
FIG. 3 is a schematic diagram of an exemplary embodiment of a contactless interface.
Figure 2:
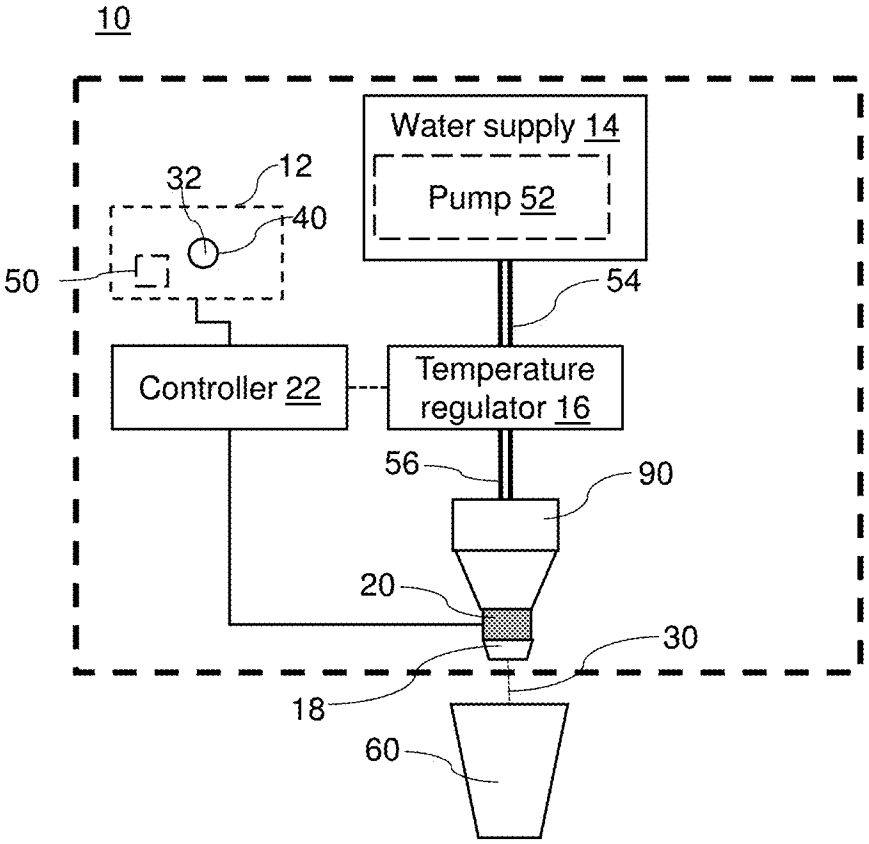
FIG. 2 is a block diagram of an exemplary embodiment of a beverage dispenser including the contactless interface.

Turning to FIGS. 1-3, an exemplary beverage dispenser 10 is shown. The beverage dispenser 10 includes a contactless interface system 12, a water supply 14, a temperature regulator 16, an outlet 18, a control valve 20, and a hardware controller 22. The temperature regulator 16 is fluidly connected to the water supply 14 and generates temperature controlled water by modulating a temperature of water supplied by the water supply 14. The hardware controller 22 controls dispensing of temperature controlled water 30 from the outlet 18 by controlling the control valve 20 based on a detection signal received from the contactless interface 12. The contactless interface system 12 includes one or more contactless interfaces 32. Each contactless interface 32 includes a sensor 40 both having a field of view 42 and configured to sense an object 44 located in a detection zone 46 of the sensor 40. Each contactless interface 32 also includes circuitry 50 for outputting a detection signal while the object 44 is sensed within the detection zone 46.

As shown in the exemplary embodiment depicted in FIG. 3, the detection zone 46 is an area within the field of view 42 and at a distance less than a maximum detection distance from the sensor 40. For example, the maximum distance threshold may be less than four inches, less than three inches, less than 2.5 inches, less than two inches, or less than one inch. FIG. 3 shows a top down view of the contactless interface 32 with the detection zone 46 extending from the contactless interface system 12 as a cone or triangle. The detection zone 46 is not limited to a triangular shape, but may have any suitable shape for sensing an object 44 near the sensor 40. For example, the sensor 40 may have a detection zone 46 that is shaped to avoid overlap with neighboring contactless interfaces 32.

As an example, FIGS. 1A and 1B both show a contactless interface system 12 having three contactless interfaces 32. In FIG. 1A, the contactless interfaces 32 are located on a front side of the beverage dispenser 10, while in FIG. 1B the contactless interfaces 32 are located on a top side of the beverage dispenser 10. As shown in FIG. 1B, the beverage dispenser 10 may also include touch buttons 33 and contactless interfaces 32. Each of the contactless interfaces 32 may have a differently shaped detection zone 46. For example, the right most contactless interface 32 may have a detection zone 46 that is shifted to cover an area to a right compared to a detection zone 46 of the other two contactless interfaces 32. Similarly, the left most contactless interface 32 may have a detection zone that is shifted to cover an area more towards a left of the contactless interface 32 as compared to the other two contactless interfaces 32.

Alternatively, the contactless interfaces 32 may each have a same detection zone 46. In one embodiment, the contactless interfaces 32 may have a detection zone that is adjustable, such that the detection zone 46 is adjustable to avoid overlapping detection zones 46 with neighboring contactless interfaces 32 that maybe positioned near in space to one another.

As described above, the circuitry 50 of the contactless interface 32 outputs a detection signal when an object 44 is detected within the detection zone 46. The detection signal may be an electrical signal or any other suitable signal for notifying the hardware controller 22 that an object has been detected within the detection zone 46. In one embodiment, the circuitry 50 is configured to only output a detection signal while the object is sensed within the detection zone, such that the detection signal is only output when an object 44 is detected within the detection zone 46. As opposed to outputting a signal when an object 44 is detected, the circuitry 50 may not output a signal when an object 44 is detected (i.e., the detection signal is a lack of a signal).

In one embodiment, the detection signal output by the contactless interface 32 varies depending on a distance of the detected object 44 from the sensor 40. In this embodiment, the hardware controller 22 is configured to vary a flow of the liquid 30 from the outlet 18 based upon the detection signal, such that: (1) the flow of the liquid increases as the distance between the object and the sensor decreases; and (2) the flow of the liquid decreases as the distance between the object and the sensor increases.

In one embodiment, the hardware controller 22 is configured to compare the detection signal received from two contactless interfaces 32 of the contactless interface system 12 to determine which of the two contactless interfaces 32 sensed the closest object 44. For example, if both the cold water contactless interface and the ambient temperature water contactless interface sense an object (e.g., a user's finger is in front of the cold water contactless interface and a portion of the user's hand is in front of the ambient temperature water contactless interface), the controller 22 will determine which of the contactless interfaces 32 sensed the closest object 44 (e.g., based on a property of the received detection signal such as intensity, frequency, timing, etc.). The controller 22 will then dispense the temperature controlled liquid controlled by the contactless interface of the two contactless interfaces determined to be sensing the closest object. In this example, if the user's finger is closer to the cold water contactless interface than the user's hand is to the ambient temperature contactless interface, then cold water would be dispensed.

In another embodiment, the controller 22 compares the detection signal received from two contactless interfaces 32 of the contactless interface system 12 to determine which of the two contactless interfaces 32 sensed the object 44 first in time. The controller 22 then dispenses the temperature controlled water controlled by the contactless interface 32 that sensed the object first in time. For example, if a detection signal is first received by the controller 22 from a cold water contactless interface, then cold water would be dispensed.

The sensor 40 may be any suitable device for sensing an object 44 at a distance from the sensor 40. For example, the sensor 40 may be a near field sensor with a detection zone extending a limited distance (e.g., less than two inches) from the sensor 40 so that water is not mistakenly dispensed when a user is not attempting to interact with the sensor 40. In one embodiment, the sensor 40 is an infrared (IR) sensor including an IR emitter and an IR receiver. For example, the sensor 40 may be an adjustable near field combination of an IR light emitting diode (LED) emitter(s) and IR sensor(s) behind an IR translucent panel. In another embodiment, the sensor 40 is an ultrasonic sensor including an ultrasound emitter and an ultrasound receiver. In another embodiment, the sensor 40 uses a combination of an IR sensor and an ultrasonic sensor to detect the object 44 within the detection zone 46.

The contactless interface 12 may be placed in close proximity (e.g., within less than two inches) of touch sensors (e.g., traditional mechanically actuated buttons). This placement improves cost efficiency for retrofitting existing beverage dispensers with contactless interfaces and also improves user interface experience, because the format creates both a touch and touchless interface out of the same user points of contact. For example, a user can either touch a button for cold water or instead hover their finger(s) within 0.75-1.5 inches of a cold water contactless interface.

As shown in the embodiment depicted in FIG. 2, the water supply 14 supplies water to the temperature regulator 16. The water supply 14 may comprise a connection to an exterior water source such as a waterline of a building. The water supply 14 may also include a pump 52 for supplying water to the temperature regulator 16 at a sufficient pressure. For example, the water supply 14 may be a water reservoir that simply holds water added to the beverage dispenser 10 (e.g., by a user). The pump 52 may be used to pressurize the water such that water from the water supply 14 is received by the temperature regulator 16.

Other devices may be provided to transport the water to and from the temperature regulator 16. Various pumps, valves, motors, and/or pneumatic devices may be arranged along the supply line 54 to move the water along the supply line 54 toward the temperature regulator 16. The water supply 14 may be oriented substantially vertically with the supply line 54 and the water supply 14 arranged above the temperature regulator 16 such that the water may be assisted by gravity in entering the temperature regulator 16 from the water supply 14.

Similarly, the temperature regulator 16 may also be arranged in the beverage dispenser 10 above the control valve 20 and the outlet 18. In the embodiment depicted in FIG. 2, the temperature regulator 16 is arranged independently from the water supply 14 and the temperature regulator 16 may include a reservoir for storing or holding the water from the water supply 14. For example, the temperature regulator 16 may alter a temperature of water located in the reservoir and output the temperature regulated water from the reservoir based upon control signals received from the hardware controller 22.

The temperature regulated water may be moved from the temperature regulator 16 to the outlet 18 via a supply line 56. The temperature regulated water may then be dispensed from the outlet 18 into a container 60. For example, the dispensed liquid 30 may be dispensed into any suitable container 60 such as a cup, mug, water, bottle, etc.

The supply lines 54, 56 used in the beverage dispenser 10 may include any suitable hoses, tubing, and fluid connectors configured for fluid transport. In other embodiments, various pumps, valves, motors, and/or pneumatic devices may be arranged along the supply lines 54, 56 to move the liquid toward the outlet 18. While the embodiments described herein are frequently described with reference to water, any suitable liquid may be used and examples of suitable liquids include water, alkaline water, carbonated water, carbonated water that is made with alkaline water, flavored carbonated or non-carbonated water, or other non-beverage liquids for other applications including and not including temperature control requirements.

As described above, the beverage dispenser 10 includes a hardware controller 22 (also referred to as a control system) for controlling the dispensing of liquids from the beverage dispenser 10. The hardware controller 22 is communicatively coupled with a control valve 20 that is arranged to control dispensing of the temperature regulated water 30 from the temperature regulator 16. The control valve 20 may be opened, closed, or partially opened or closed by the hardware controller 22 to meter the amount of temperature controlled water 30 dispensed from the outlet 18. The hardware controller 22 may also be communicatively coupled with the water supply 14 to control water flowing from the water supply 14 to the temperature regulator 16.

Any suitable electronic lines, wiring, cables, harnesses, etc. may be used to connect the hardware controller 22 with the corresponding components of the beverage dispenser 10 and the hardware controller 22 may be automated.

Figure 4:
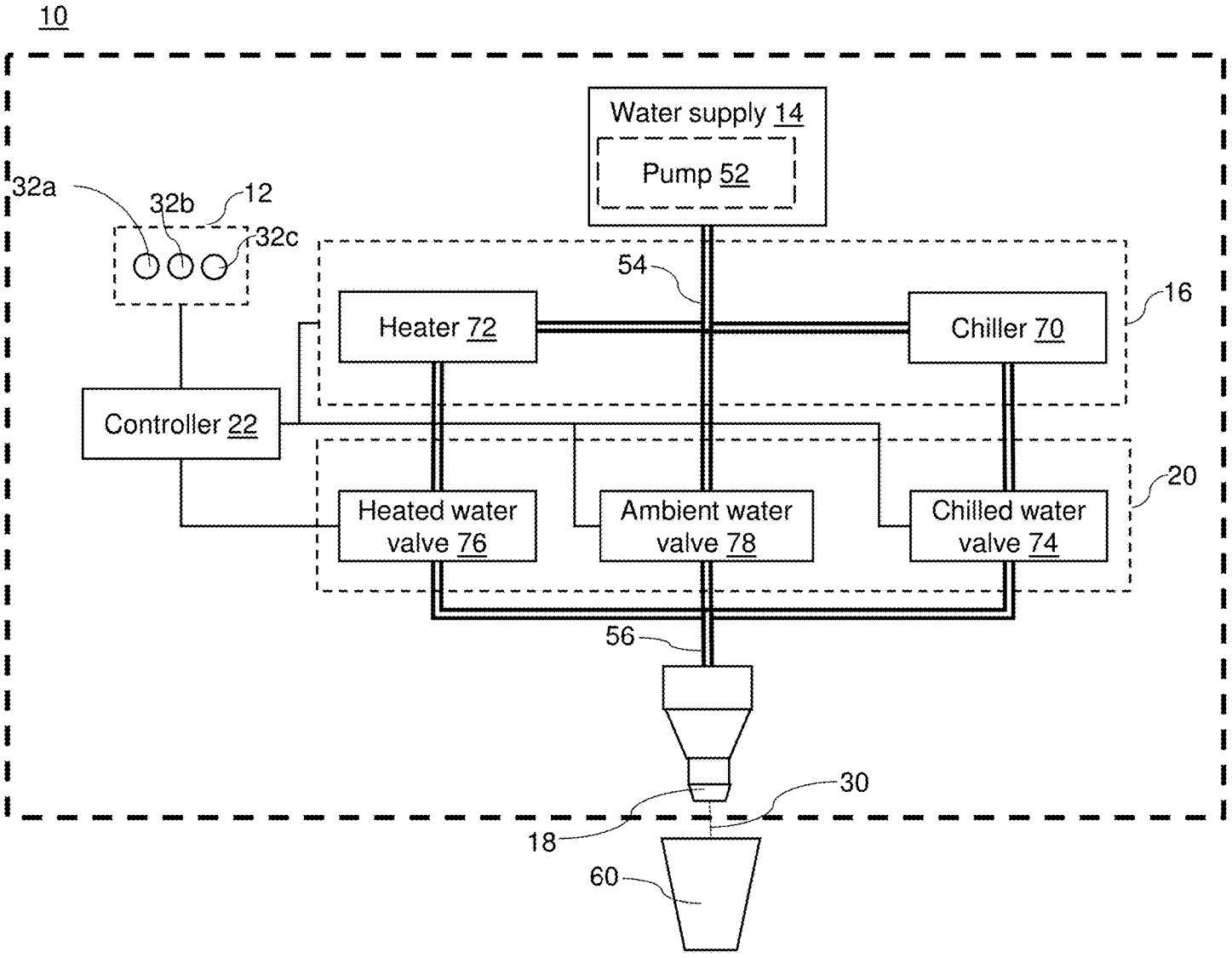
FIG. 4 is a block diagram of an exemplary embodiment of a beverage dispenser including a heater and a chiller.

In the embodiment shown in FIG. 4, the temperature regulator 16 includes a chiller 70 and a heater 72. The chiller 70 is configured to receive water from the water supply 14 and output chilled water having a lower temperature than the water received from the water supply 14. Similarly, the heater 72 is configured to receive water from the water supply 14 and output heated water having a higher temperature than the water received from the water supply. For example, the chiller 70 and the heater 72 may be set to chill and heat, respectively, received water to a set temperature.

In an exemplary embodiment, the cooler 70 is fluidly connected to the supply line 54 for cooling the water as the water travels from the water supply 14 towards the output 18. The cooler 70 may be configured to cool the water to a temperature that is between 1 and 8 degrees Celsius (between 35 and 45 degrees Fahrenheit). The cooling temperature may be dependent on whether the water is being stored or moving toward the output 18. To maintain cool temperatures, a supply line may be thermally insulated. Any suitable cooling device or components may be used to cool the water, including heat exchangers, desiccants, insulators, evaporators, condensers, compressors, expansion valves, cooling fans, etc.

In an exemplary embodiment, the heater 72 is fluidly connected to the supply line 54 for heating the water as the water travels from the water supply 14 towards the output 18. The heater 72 may be configured to heat the water to a temperature that is between 35 and 70 degrees Celsius (between 100 and 160 degrees Fahrenheit). The heating temperature may be dependent on whether the water is being stored or moving toward the output 18. To maintain hot temperatures, a supply line may be thermally insulated. Any suitable heating device or components may be used to heat the water.

In the embodiment shown in FIG. 4, the control valve 20 includes a chilled water valve 74 and a heated water valve 76. The heated water valve 76 is configured to regulate dispensing of the heated water from the outlet 18. Similarly, the chilled water valve 74 is configured to regulate dispensing of the chilled water from the outlet 18.

With continued reference to FIG. 4, the contactless interface system 12 may include multiple contactless interfaces 32 including a chilled contactless interface 32*a* and a heated contactless interface 32*b*. The chilled contactless interface 32*a* and the heated contactless interface 32*b* are both operatively coupled to the hardware controller 22. The hardware controller 22 is configured to modulate dispensing of chilled water and hot water by the beverage dispenser. That is, the chilled contactless interface 32*a* outputting a detection signal results in dispensing of the chilled water by the beverage dispenser, while the heated contactless interface 32*b* outputting the detection signal results in dispensing of the heated water.

The hardware controller 22 is configured to control the control valve 20 such that the heated water is dispensed from the output 18 when the heated contactless interface 32*b* outputs the detection signal. Conversely, the hardware controller 22 is configured to control the control valve 20 such that the chilled water is dispensed from the output 18 when the chilled contactless interface 32*a* outputs the detection signal.

In the depicted embodiment, the circuitry 50 of the heated contactless interface 32*b* only outputs the detection signal while an object is sensed within the detection zone after: (1) sensing the object within the detection zone; (2) issuing a notification; and (3) after a time delay following issuing the notification, sensing the object within the detection zone. This twice detection requirement is meant as a safety requirement to prevent accidental dispensing of heated water.

To dispense heated water in this embodiment, an object 44 must be sensed within the detection zone 46 of the heated contactless interface 32*b*. A notification is then issued by the heated contactless interface 32*b*. For example, the notification may be issued as at least one an audible notification by a speaker or a visible notification by a light emitter (e.g., a light emitting diode (LED)). This notification serves to indicate to a user that a first input to the heated contactless interface 32 has been received.

After issuing the notification, the heated contactless interface 32*b* waits an interval of time (i.e., the time delay) and then again checks for an object 44 within the detection zone 46 of the heated contactless interface 32*b*. If an object 44 is detected within the detection zone 46 by the heated contactless interface 32*b* before the expiration of a safety time threshold (e.g., ten seconds, five seconds, or three seconds), then the heated contactless interface 32*b* outputs the detection signal, such that the hardware controller 22 causes heated water to be dispensed from the output 18. The safety time threshold is used to ensure that two interactions with the heated contactless interface 32*b* are close enough in time to indicate that a user would like to dispense heated water. The time delay is used to ensure that a user does not accidentally cause heated water to be dispensed by leaving their finger over the heated contactless interface 32*b*.

To further ensure that a user does not accidentally cause heated water to be dispensed by accidentally leaving their finger in front of the heated contactless interface 32*b*, the time delay may only begin when the object 44 is no longer sensed within the detection zone 46. For example, a user may be required to place their finger in the detection zone 46 of the heated contactless interface 32*b*, remove their finger from the detection zone 46, and then place their finger back into the detection zone 46 of the heated contactless interface 32*b*.

Figure 5:
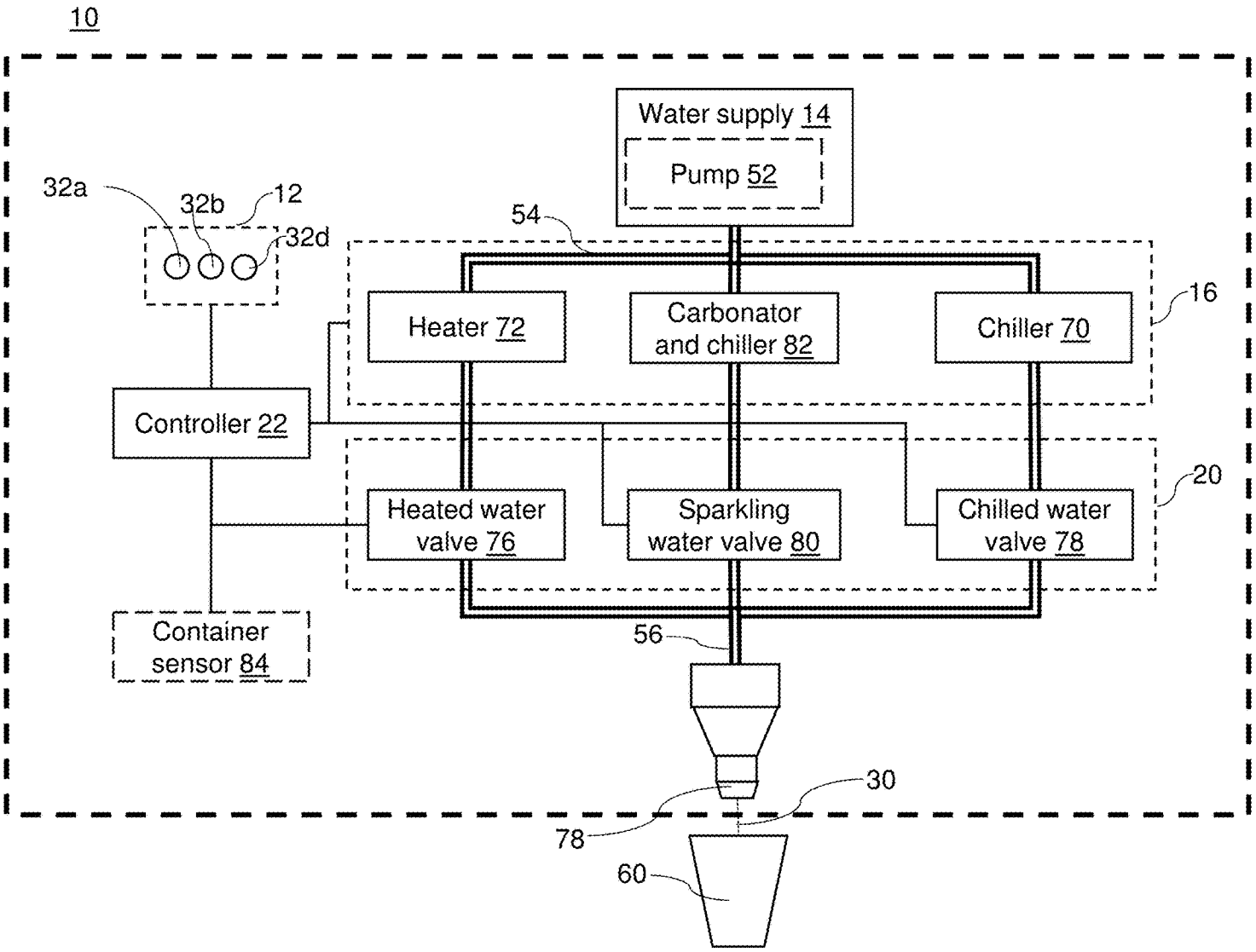
FIG. 5 is a block diagram of an exemplary embodiment of a beverage dispenser including a heater, a chiller, and a carbonator.

As shown in the embodiments depicted in FIGS. 4 and 5, the contactless interface 12 may additionally include at least one of an ambient contactless interface 32*c* or a sparkling contactless interface 32*d*. The ambient contactless interface 32*c* is operatively coupled to the controller 22. The controller 22 is configured to modulate dispensing of ambient temperature water, such that the ambient contactless interface 32*d* outputting the detection signal results in dispensing of the ambient temperature water by the beverage dispenser 10. Similarly, the sparkling contactless interface 32*d* is operatively coupled to the controller 22 and the controller 22 is configured to modulate dispensing of sparkling temperature water, such that the sparkling contactless interface 32*d* outputting the detection signal results in dispensing of the sparkling temperature water by the beverage dispenser.

When the contactless interface system 12 includes a sparkling contactless interface 32*d*, the beverage dispenser 10 may additionally include a carbonator 82. The carbonator 82 is configured to carbonate water received from the water supply 14. The carbonated water generated by the carbonator 82 may be chilled via the chiller 70 or the carbonator 82 may include a chiller for chilling the carbonated water. The same chiller 70 (also referred to as a cooling device) or a second chiller may also be provided to cool the carbonated water generated by the carbonator 82. For example, the carbonator 82 may carbonate chilled water received from the chiller 70.

The carbonator 82 may be fluidly connected to a carbon dioxide supply and the water supply 14. In this embodiment, the supply line 54 is fluidly connected to the carbonator 82 for transferring the water from the water supply 14 to the carbonator 82. The carbonator 82 may include any suitable valves or control lines and the hardware control 22 may also be configured to operate the carbonator 82.

Figure 7:
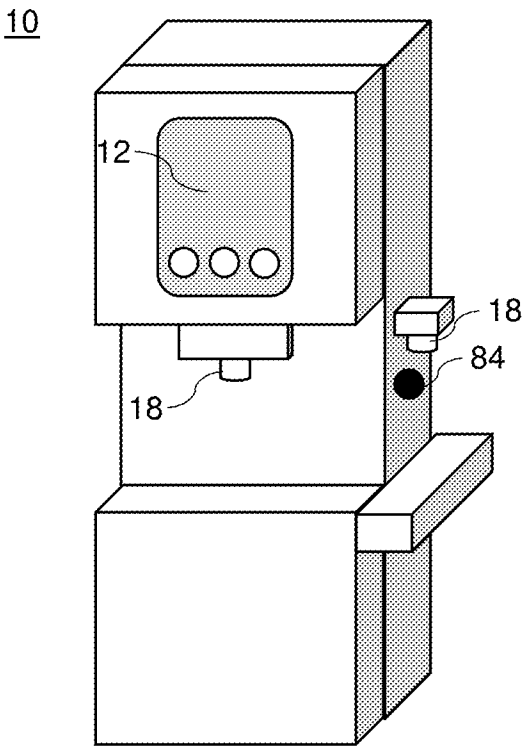
FIG. 7 is a schematic diagram of an alternative exemplary embodiment of a beverage dispenser including a container contactless interface.
Figure 6:
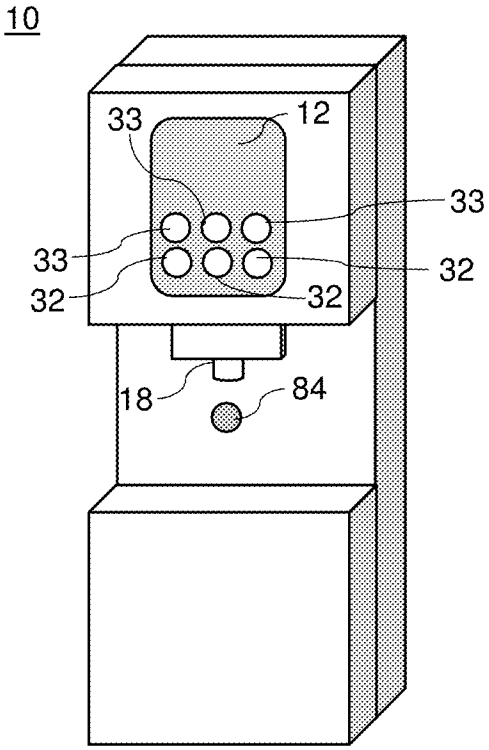
FIG. 6 is a schematic diagram of an exemplary embodiment of a beverage dispenser including a container contactless interface.
Figure 8:
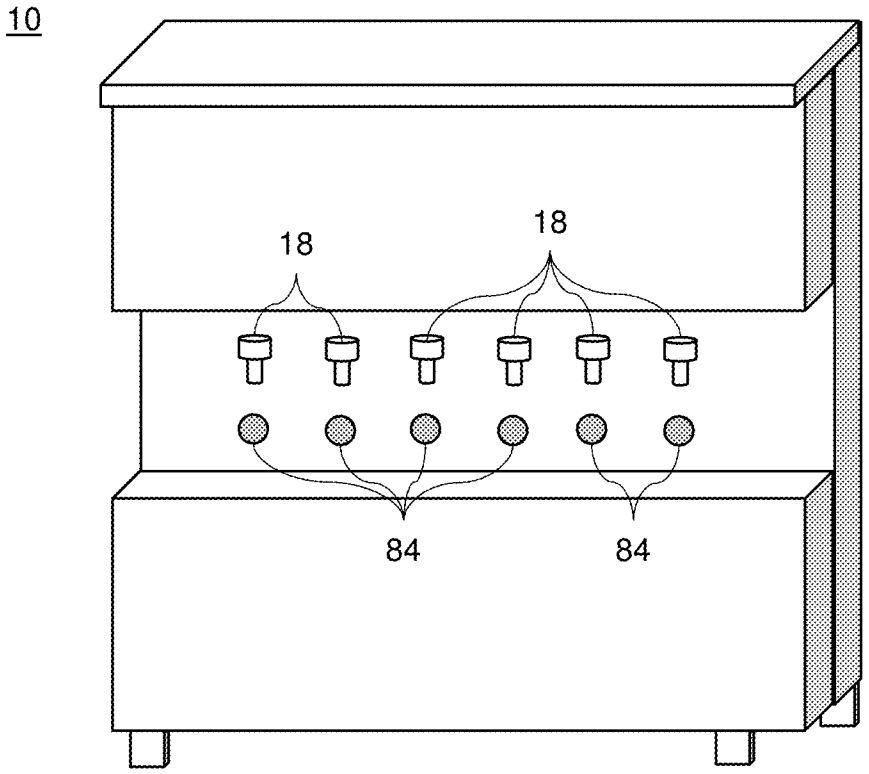
FIG. 8 is a schematic diagram of an exemplary embodiment of a beverage dispenser including multiple container contactless interfaces and multiple dispensing outlets.

In the embodiments shown in FIGS. 6-8, the beverage dispenser 10 includes multiple contactless interfaces 32 that include a container contactless interface 84 (also referred to as a cup detector or a bottle detector. In the embodiment shown in FIG. 6, the container contactless interface 84 is located under the same outlet 18 that dispenses water based on signals from the other contactless interfaces 32. Conversely, in the embodiment shown in FIG. 7, the beverage dispenser 10 includes two outlets 18 and the container contactless interface 84 is located on a side of the beverage dispenser 10. For example, the container contactless interface 84 may be a secondary bottle fill dispensing point that is separate from a primary dispensing area on a front of the beverage dispenser 10.

In the embodiment shown in FIG. 8, the outlet 18 includes multiple separate outlets 18, each dispensing the temperature controlled water. In this embodiment, the control valve 20 includes multiple control valves 20 and each of the multiple control valves is configured to control dispensing of the temperature controlled water from an associated outlet 18 of the multiple separate outlets 18. The contactless interface 32 is embodied as one of multiple container contactless interfaces 84 in a contactless interface system 12. Each of the multiple container contactless interfaces 84 include a sensor and circuitry and is positioned relative to an associated outlet 18. The sensor has a field of view and is configured to sense a container 60 located in a detection zone of the sensor. The circuitry is configured to output a detection signal while the object is sensed within the detection zone. The hardware controller 22 is communicatively coupled with each of the multiple control valves 22 and each of the multiple container contactless interfaces 32. The hardware controller is configured to control dispensing of the temperature controlled water from each of the multiple outlets associated with one of the multiple control valves outputting a detection signal.

The container contactless interface 84 is operatively coupled to the controller 22 of the beverage dispenser 10, such that the container contactless interface 84 outputting a detection signal results in dispensing of a default water type by the beverage dispenser 10. The container contactless interface 84 may be the same combination of sensor and circuitry as the contactless interfaces 32 described above. For example, the container contactless interface 84 may utilize an IR sensor or an ultrasonic sensor. The container contactless interface 84 may be calibrated to differentiate between containers 60 and other objects (e.g., a user's hand) or the container contactless interface 84 may output a detection signal whenever an object 44 is detected.

As described above, the controller 22 causes a default temperature water to be output when a detection signal is received from the container contactless interface 84. The default temperature water may be set to be chilled water. Alternatively or additionally, the default water temperature may be set by a user.

Figure 9:
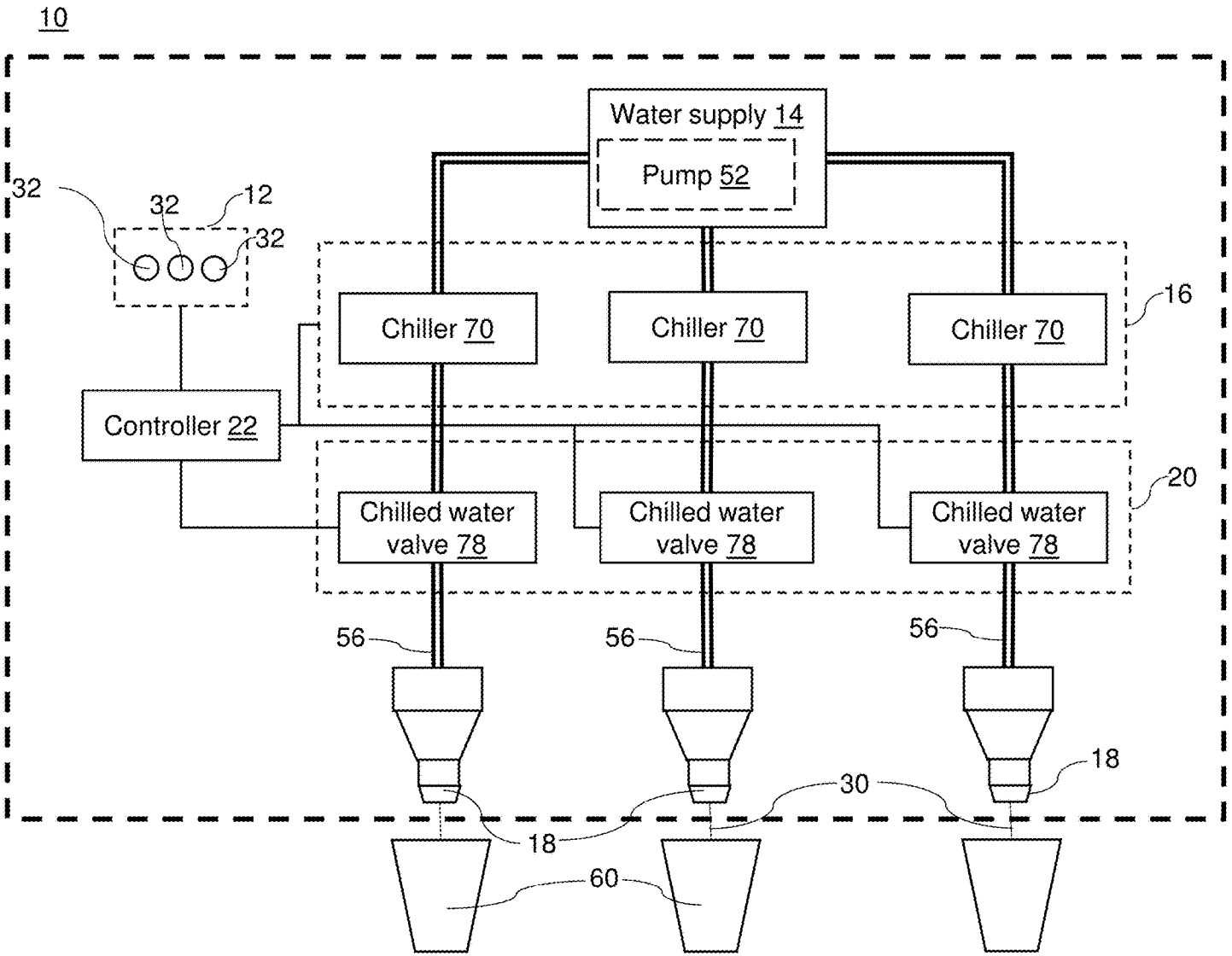
FIG. 9 is a block diagram of an exemplary embodiment of a beverage dispenser including multiple container contactless interfaces and multiple dispensing outlets.

For example, in the embodiment shown in FIGS. 8 and 9, a container may be detected by the left most container contactless interface 84 and the right most container contactless interface 84. The controller 22 receives detection signals from these two container contactless interfaces and causes water to be dispensed from the outlets 18 associated with these container contactless interfaces 84 (i.e., the left most outlet and the right most outlet).

The hardware controller 22 may include any suitable electronic control mechanism, such as, for example, a central processing unit (CPU), a microprocessor, control circuitry, a processor, and other suitable components. The controller 22 may be communicatively coupled with the control valve 20, the temperature regulator 16, and the contactless interface system 12. The control valve 20 may have any suitable configuration or components to directly control the flow rate. The control valves may be rotary, having balls, butterfly or plug type closures, or linear, having globe, diaphragm or pinch type closures. Any suitable type of actuator may be used for the valves, such as a piston or diaphragm that is pneumatic, electric, or a combination thereof. Electromechanically operated valves including solenoid valves may also be suitable. Many other types of control valves may be suitable.

As described above, in an embodiment, the controller 22 is configured to provide instructions to adjust the control valve 20 (e.g., including the chilled water valve 74, heated water valve 76, ambient water valve 78, sparkling water valve 80, etc.) for controlling dispensing of liquid from the output 18.

The beverage dispenser 10 may include a volume sensor 90 configured to measure a volume of fluid dispensed by the beverage dispenser 10. The volume sensor may be any suitable sensor for determining a dispensed volume of fluid. For example, the volume sensor may be a flow sensor and the output of the flow sensor may be used to determine a dispensed volume over a period of time. As another example, the volume sensor may be implemented by the control 22 and may estimate the dispensed volume based on the time that fluid was dispensed by the beverage dispenser 10 based on a known flow rate of the beverage dispenser 10.

In one embodiment, the flow detector is configured to determine a volume of the dispensed liquid for a continuous dispensing of the liquid caused by receiving a continuous detection signal from the contactless interface. That is, the flow detector determines the volume of dispensed liquid for a single continuous dispensing operation (as opposed to a volume of dispensed liquid due to multiple sequential dispensing operations). When the determined volume is greater than or equal to a volume threshold, the controller 22 is configured to stop dispensing the liquid (independent of the detection signal) until: (1) a lull in the continuous detection signal is received indicating that the object is no longer detected; and (2) after receiving the lull, a renewed detection signal is received from the contactless interface.

For example, the volume threshold may be twelve ounces. When a user places their finger in front of the cold contactless interface 32*a* to dispense cold water, the controller 22 may stop dispensing of the cold water at twelve ounces (i.e., the volume threshold). For the user to dispense more cold water, the user needs to remove their finger so that it is no longer detected by the cold contactless interface 32*a* and then the user needs to replace their finger so that it is again detected by the cold contactless interface 32*a*.

The controller 22 may limit the volume of liquid output during a continuous dispensing operation to reduce the risk of a user overfilling their container 60. For example, many countertop units do not include drains or include drains with a limited capacity. In such systems, reducing the possibility that user's will overfill their beverage container (e.g., a cup, water bottle, mug, etc.) may be more important.

In the embodiment shown in FIGS. 10 and 11, the sensor 40 may be positioned near to a touch sensitive input 33. The sensor 40 includes an IR transparent panel 90 (in FIG. 11 the IR transparent panel is an IR transparent touch panel) and IR diodes 92. In the embodiment shown in FIG. 10 the touch sensitive input 33 is a mechanically actuated button including a biasing element 94 (such as a spring). In this embodiment, pressing on the IR transparent panel 90 pushes against the biasing member 94 and causes a button press to be received by the controller 22. Alternatively, instead of pressing against the IR transparent panel 90, a user may place their finger in front of the IR transparent panel such that their finger is detected by the IR diodes of the contactless interface 32.

In the embodiment shown in FIG. 11, the IR diodes 92 are located near a touch sensor 33 (e.g., above, below, to the right or left, etc.). In this embodiment, the user may either touch the IR touch panel 90 or interact with the contactless interface 32.

All ranges and ratio limits disclosed in the specification and claims may be combined in any manner. Unless specifically stated otherwise, references to "a," "an," and/or "the" may include one or more than one, and that reference to an item in the singular may also include the item in the plural.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A beverage dispenser comprising:

a water supply;

a temperature regulator configured to generate temperature controlled water by modulating a temperature of water supplied by the water supply, wherein the temperature regulator includes:

a chiller configured to receive water from the water supply and output chilled water having a lower temperature than the water received from the water supply; and a heater configured to receive water from the water supply and output heated water having a higher temperature than the water received from the water supply;

a contactless interface system comprising multiple contactless interfaces, wherein each of the multiple contactless interfaces includes:

a sensor having a field of view and configured to sense an object located in a detection zone of the sensor, wherein the detection zone is an area within the field of view and at a distance less than a maximum detection distance from the sensor; and circuitry configured to output a detection signal while the object is sensed within the detection zone, wherein the multiple contactless interfaces include a chilled contactless interface and a heated contactless interface;

an outlet configured to dispense the temperature controlled water;

a control valve configured to regulate dispensing of the temperature controlled water from the outlet, wherein the control valve includes:

a heated water valve configured to regulate dispensing of the heated water from the outlet; and a chilled water valve configured to regulate dispensing of the chilled water from the outlet; and a hardware controller communicatively coupled with the chilled contactless interface, the heated contactless interface, and the control valve, wherein the hardware controller is configured to control dispensing of liquid from the outlet by controlling the control valve based on the detection signal, such that:

the heated water is dispensed from the output when the heated contactless interface outputs the detection signal; and the chilled water is dispensed from the output when the chilled contactless interface outputs the detection signal, and wherein the hardware controller is configured to:

compare the detection signal received from two contactless interfaces of the contactless interface system to determine which of the two contactless interfaces sensed the closest object or the object first in time; and dispense the temperature controlled water controlled by the contactless interface of the two contactless interfaces determined to be sensing the closest object or to have sensed the object first in time.

2. The beverage dispenser of claim 1, wherein the sensor is an infrared (IR) sensor including an IR emitter and an IR receiver.

3. The beverage dispenser of claim 1, wherein the sensor is an ultrasonic sensor including an ultrasound emitter and an ultrasound receiver.

4. The beverage dispenser of claim 1, wherein the detection zone is less than four inches.

5. The beverage dispenser of claim 1, wherein the circuitry of the heated contactless interface is further configured to:

output the detection signal while the object is sensed within the detection zone only after:

sensing the object within the detection zone;

issuing a notification; and after the issuing of the notification and after a time delay, sensing the object within the detection zone.

6. The beverage dispenser of claim 5, wherein the time delay only begins when the object is no longer sensed within the detection zone.

7. The beverage dispenser of claim 5, wherein the heated contactless interface further includes at least one of:

a speaker and the notification is issued as an audible notification by the speaker; or a light emitter and the notification is issued as a visible notification by the light emitter.

8. The beverage dispenser of claim 1, wherein:

the multiple contactless interfaces further include at least one of an ambient contactless interface or a sparkling contactless interface;

the ambient contactless interface is operatively coupled to the controller of the beverage dispenser and the controller is configured to modulate dispensing of ambient temperature water, such that the ambient contactless interface outputting the detection signal results in dispensing of the ambient temperature water by the beverage dispenser; and the sparkling contactless interface is operatively coupled to the controller of the beverage dispenser and the controller is configured to modulate dispensing of sparkling temperature water, such that the sparkling contactless interface outputting the detection signal results in dispensing of the sparkling temperature water by the beverage dispenser.

9. The beverage dispenser of claim 1, wherein:

the multiple contactless interfaces further include a container contactless interface;

the container contactless interface is operatively coupled to the controller of the beverage dispenser, such that the container contactless interface outputting the detection signal results in dispensing of a default water type by the beverage dispenser.

10. The beverage dispenser of claim 9, wherein the default water type is chilled water.

11. A beverage dispenser comprising:

a water supply;

a temperature regulator configured to generate temperature controlled water by modulating a temperature of water supplied by the water supply;

a contactless interface including:

a sensor having a field of view and configured to sense an object located in a detection zone of the sensor, wherein the detection zone is an area within the field of view and at a distance less than a maximum detection distance from the sensor; and circuitry configured to output a detection signal while the object is sensed within the detection zone, wherein the detection signal is an electrical signal;

an outlet configured to dispense the temperature controlled water;

a control valve configured to control dispensing of the temperature controlled water from the outlet;

a hardware controller communicatively coupled with the contactless interface and the control valve, wherein the hardware controller is configured to control dispensing of the temperature controlled water from the outlet by controlling the control valve based on the detection signal; and a volume sensor communicatively coupled to the hardware controller, wherein the volume sensor is configured to determine a volume of the dispensed liquid for a continuous dispensing of the liquid caused by receiving a continuous detection signal from the contactless interface, wherein the hardware controller is further configured to:

when the determined volume is greater than or equal to a volume threshold independent of the detection signal, stop dispensing of the liquid until:

a lull in the continuous detection signal is received indicating that the object is no longer detected;

after receiving the lull, a renewed detection signal is received from the contactless interface.

12. The beverage dispenser of claim 11, wherein the detection signal output by the contactless interface varies depending on a distance of the detected object from the sensor.

13. The beverage dispenser of claim 12, wherein the hardware controller is configured to vary a flow of the temperature controlled water from the outlet based upon the detection signal, such that:

the flow of the temperature controlled water increases as the distance between the object and the sensor decreases; and the flow of the temperature controlled water decreases as the distance between the object and the sensor increases.

14. The beverage dispenser of claim 11, wherein:

the outlet includes multiple separate outlets, each dispensing the temperature controlled water;

the control valve includes multiple control valves, each of the multiple control valves configured to control dispensing of the temperature controlled water from an associated outlet of the multiple separate outlets;

the contactless interface is included as one of multiple container contactless interfaces in a contactless interface system;

each of the multiple container contactless interfaces is positioned relative to an associated outlet of the multiple separate outlets and:

includes a sensor having a field of view and configured to sense a container located in a detection zone of the sensor; and includes circuitry configured to output a detection signal while the object is sensed within the detection zone;

the hardware controller is communicatively coupled with each of the multiple control valves and each of the multiple container contactless interfaces;

the hardware controller is configured to control dispensing of the temperature controlled water from each of the multiple outlets associated with one of the multiple control valves outputting a detection signal.

15. A beverage dispenser comprising:

a water supply;

a temperature regulator configured to generate temperature controlled water by modulating a temperature of water supplied by the water supply;

a contactless interface including:

a sensor having a field of view and configured to sense an object located in a detection zone of the sensor, wherein the detection zone is an area within the field of view and at a distance less than a maximum detection distance from the sensor; and circuitry configured to output a detection signal while the object is sensed within the detection zone, wherein the detection signal is an electrical signal;

an outlet configured to dispense the temperature controlled water;

a control valve configured to control dispensing of the temperature controlled water from the outlet; and a hardware controller communicatively coupled with the contactless interface and the control valve, wherein the hardware controller is configured to control dispensing of the temperature controlled water from the outlet by controlling the control valve based on the detection signal, wherein the detection signal output by the contactless interface varies depending on a distance of the detected object from the sensor, and wherein the hardware controller is configured to vary a flow of the temperature controlled water from the outlet based upon the detection signal, such that:

the flow of the temperature controlled water increases as the distance between the object and the sensor decreases; and the flow of the temperature controlled water decreases as the distance between the object and the sensor increases.

* * * * *